United States Patent [19]

Funkhouser, Jr.

[11] Patent Number: 4,844,455

[45] Date of Patent: Jul. 4, 1989

[54] TENNIS NET TIGHTENING APPARATUS

[75] Inventor: Richard N. Funkhouser, Jr., Hagerstown, Md.

[73] Assignee: Har-Tru Corporation, Hagerstown, Md.

[21] Appl. No.: 135,368

[22] Filed: Dec. 21, 1987

[51] Int. Cl.[4] ..... A63B 61/02

[52] U.S. Cl. ..... 273/29 BF

[58] Field of Search ..... 273/29 BB, 29 BC, 29 BD, 273/29 BE, 29 BF, 29 BG

[56] References Cited

U.S. PATENT DOCUMENTS 4,065,099 12/1977 Germain ..... 273/29 BE

FOREIGN PATENT DOCUMENTS 27210 11/1912 United Kingdom ..... 273/29 BF
206027 11/1923 United Kingdom ..... 273/29 BD
237024 7/1925 United Kingdom ..... 273/29 BF
2121293A 12/1983 United Kingdom ..... 273/29 BB

OTHER PUBLICATIONS

"Mechanisms, Linkages, and Mechanical Controls", Chironis, Nicholas P., McGraw-Hill, 1965, p. 182.
Court 1 Brochure.

*Primary Examiner*—Edward M. Coven
*Assistant Examiner*—Benjamin Layno
*Attorney, Agent, or Firm*—William L. Gates; David S. Scrivener

[57] ABSTRACT

A tennis net tightening assembly adapted for installation as a unit inside the upper end of an existing tennis net post and which comprises an elongated threaded shaft journaled between a pair of support plates, one of which contacts a portion of the lower inner wall surface of the net post while the other support plate is fitted to the lower portion of a collar which is adapted to seat on the top of the net post and extends upwardly therefrom. A captured nut is located on the threaded shaft and includes a hook for engaging one end of the net support cable. The support cable passes through a slot in the upper portion of the collar, which additionally includes a semi-circular cable guide element adjacent the slot. The elongated threaded shaft is journaled between the support plates and includes a shank at its upper end which passes through the collar and is protected thereby. The shank terminates in a square headed end portion which can be engaged by a wrench for turning the shaft and thus loosening or tightening the cable by linear travel of the captured nut along the shaft.

20 Claims, 2 Drawing Sheets

TENNIS NET TIGHTENING APPARATUS

BACKGROUND OF THE INVENTION

This invention relates generally to means for tightening the slack in a line and more particularly to apparatus for tightening a net cable passing through the upper horizontal portion of a tennis net which is supported between a pair of vertical standards or net posts.

Tension is generally applied to a tennis net by including well known means located on at least one of the net posts for removing any slack in the cable passing through the tape which extends horizontally across the top of the net. Various types of tensioning devices have been utilized and take many forms. One serious disadvantage of such apparatus is its being located on the side of the net posts. This has been found to be a source of serious injury to tennis players due to the external projections presented thereby. Aside from being somewhat unsightly, these net tighteners also lend themselves to undesired tampering and theft of both the net and tightener.

This then has resulted in a recent appearance of tennis net tightening devices which are incorporated into the tennis net post and include means located on the inside of the post for tightening the net cable. What is significant about such arrangements is that they require the removal of the pre-existing post and a replacement of a complete new net post incorporating the in-post tensioning mechanism therein.

It is an object of the present invention, therefore, to provide an improved type of net tightening apparatus.

It is a further object of the invention to provide an improvement in in-post tennis net tightening apparatus;

It is yet another object of the invention to provide an improved in-post tennis net tightening apparatus which can be inserted as an adapter unit on an existing tennis net post without any modification thereof.

SUMMARY

The foregoing and other objects of the invention are accomplished by an elongated threaded shaft containing a captured nut having a hook for receiving the end of a tennis net cable. The threaded shaft is journaled between upper and lower flat plate members having external perimeter surfaces which conform to the internal surface of the net post with the lower plate contacting the interior surface thereof. The perimeter surface of the upper plate is bonded or otherwise fitted to the inner surface of the lower portion of a collar member having a cross section and external dimension which conforms to the net post. A square angle bracket member extends between the upper and lower plates for capturing the nut, causing it to travel up and down the threaded shaft when it is turned. The collar includes an aperture or slot at its upper end for receiving one end of the net cable therethrough. Adjacent the slot on the interior of the collar is a semi-circular cable guide member. The upper plate, moreover, has a section removed therefrom at the location of the cable guide member so that one end of the cable can pass therethrough unobstructed to the hook on the captured nut. A pair of opposing depending. sleeve segments extend from the bottom of the collar which are adapted to fit inside of the net post for stabilizing and holding the collar in place thereon. The upper end of the threaded screw includes a shank portion which projects through the upper plate and includes a square headed end which is adapted to engage one end of a wrench that is adapted to fit down inside of the apparatus when not in use. Furthermore, a cap is provided which fits on top of the collar to protect the inner workings of the apparatus following a tightening or untightening operation.

BRIEF DESCRIPTION OF THE DRAWINGS

The objects of the present invention and the intended advantages thereof will become readily apparent with reference to the following drawings taken in conjunction with the following detailed description of the invention and wherein like reference numerals refer to like parts throughout, and wherein.

DETAILED DESCRIPTION OF THE INVENTION

Figures 1, 2:
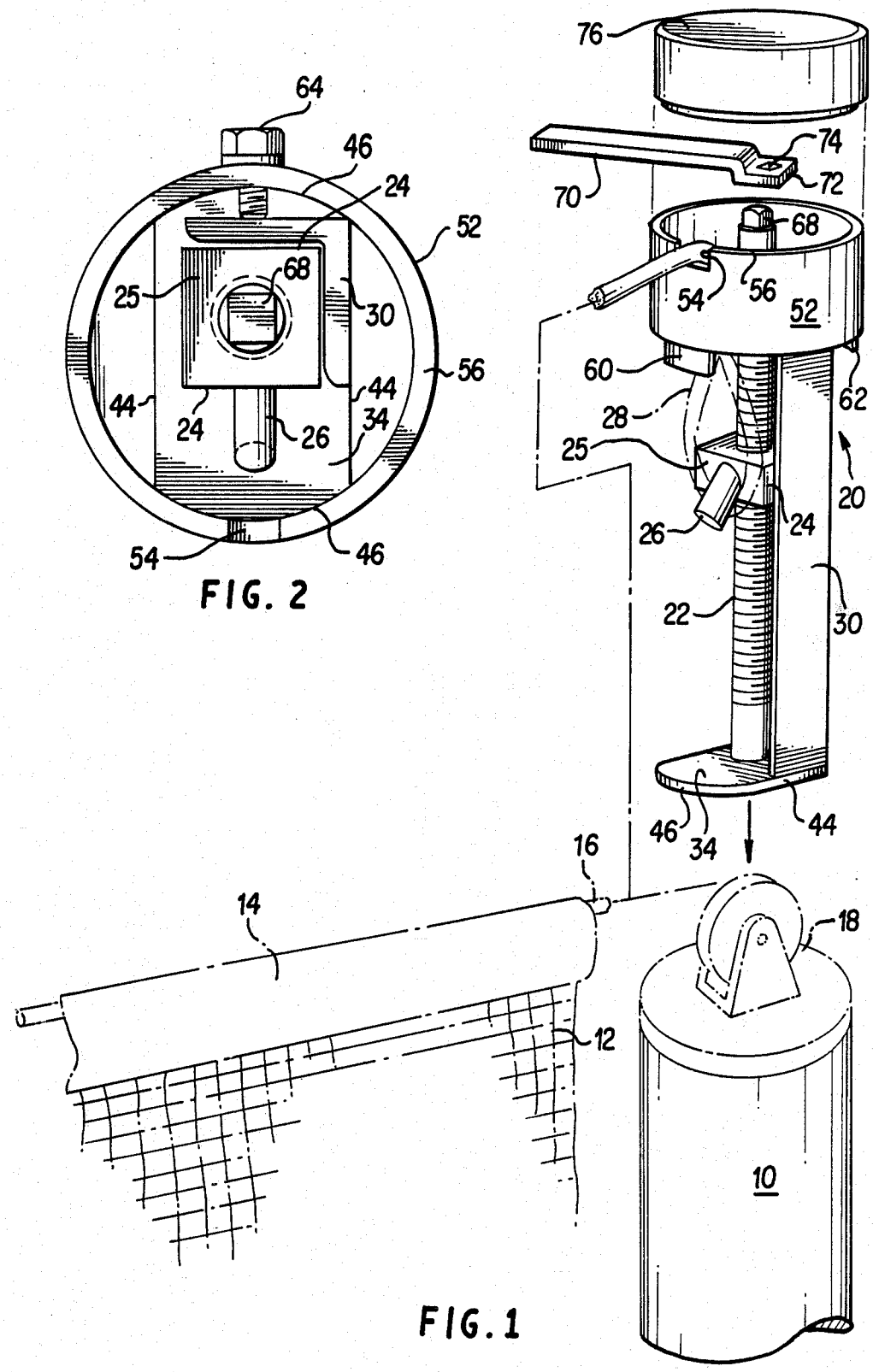
FIG. 1 is an exploded perspective view generally illustrative of the preferred embodiment of the invention.
FIG. 2 is a top plan view of the interior of the preferred embodiment of the invention with one element removed for purposes of clarity.

Referring now to the drawings, reference numeral 10 in FIG. 1 denotes a conventional net standard or post of a tennis court, not shown. As is well known, a tennis court includes a pair of net posts between which is strung a tennis net 12. A tape element 14 forms the top portion of the net through which a net cord or cable 16 extends. Conventionally, at least one end of the cable extends over a pulley block or slide 18, shown in phantom view in FIG. 1, which then attaches to, for example, an external reel type of ratchet assembly, not shown, located on the post 10. The present invention is intended to replace an external net cable tightener and comprises an integrated net tightening assembly which is insertable as an adapter unit into an existing net post 10, of either circular or rectangular cross section, in place of the element 18 without modification or replacement.

For a net post 10 of circular cross section, a preferred embodiment of the invention is comprised of an elongated threaded shaft 22 upon which is located a captured nut 24 including a threaded block body member 25 from which depends a downwardly projecting hook 26. Provided thereby is a hook nut which is adapted to engage a loop 28 formed in the end of the net cable 16. The body 25 of the hook nut 24 is restrained from rotation by an elongated right angled channel member 30 which is secured at its opposite ends to a top and bottom flat plate member 32 and 34. The plate members include centrally located holes 36 and 38 which journal upper and lower shank portions 37 and 39 (FIG. 4) of the threaded rod 22, thereby providing bearing surfaces for the rod, permitting it to be rotated and in so doing, causes the hook nut 24 to travel linearly in an upward and downward direction and thus tighten the net cable 16 when it travels downward.

Figures 3, 4:
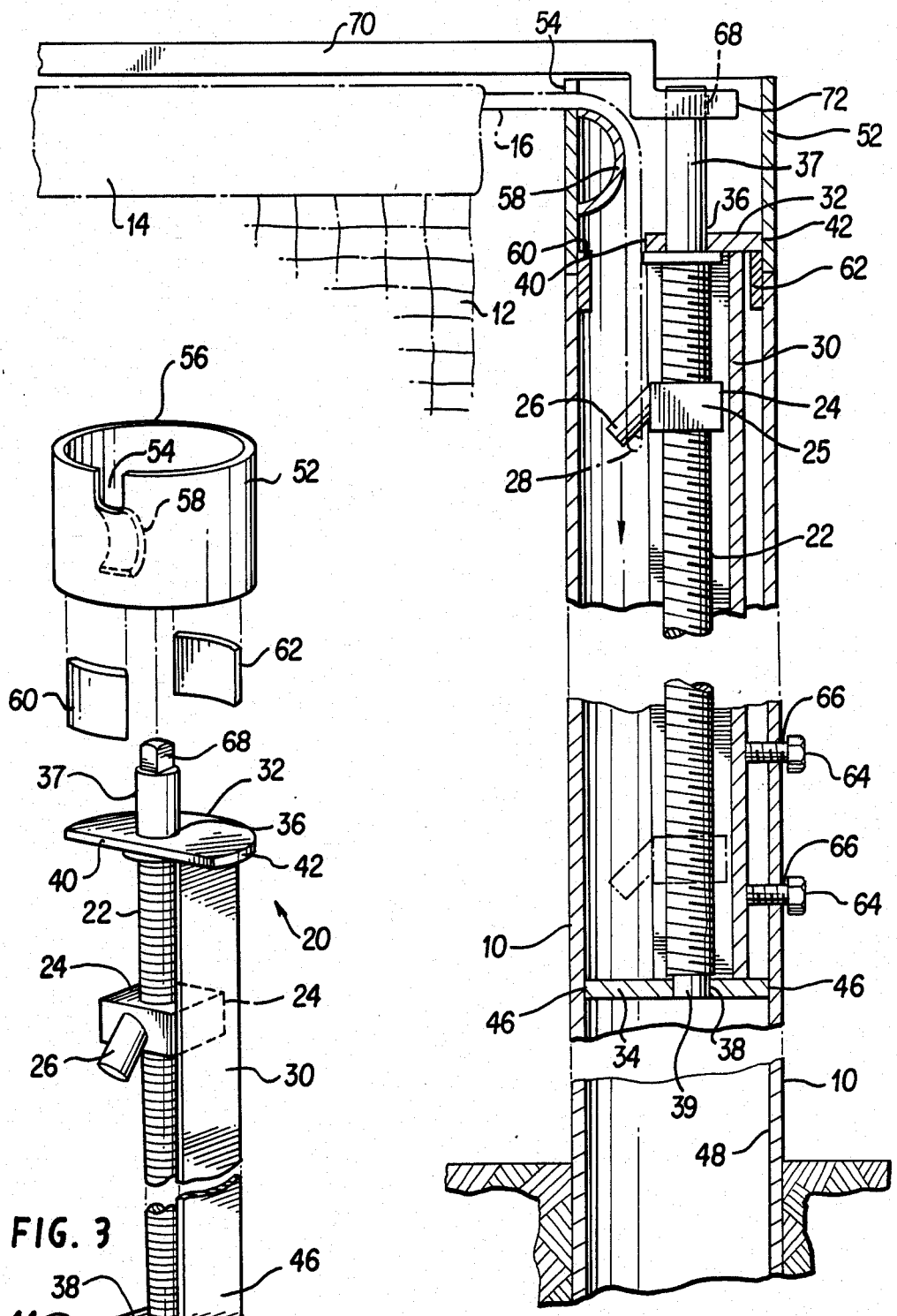
FIG. 3 is an exploded perspective view further illustrative of the preferred embodiment of the invention.
FIG. 4 is a central longitudinal cross section of the embodiment of the invention located on a conventional tennis net post.

Further as shown in FIG. 3, the upper and lower flat plates 32 and 34 comprise segments of a circle, with the upper plate 32 being generally semi-circular in configuration, including a linear chord edge 40 and a circular perimeter edge 42, whereas the lower plate includes a pair of parallel chord edges 44 and a pair of opposing circular perimeter edges 46.

The perimeter edges 46 of the lower plate 34 are adapted to engage the inner wall surface 48 of the net post 10 as shown in FIG. 4. The circular perimeter edge 50 of the upper plate 32 is bonded to the lower inner wall portion of a cylindrical collar 52 which includes an opening or slot 54 formed in the top rim portion 56 thereof to receive the net cable 16 therethrough. Adjacent the slot 54 there is located a semi-circular cable guide element 58 to provide a rounded transition of direction section for the net cable 16 where it attaches to the hook 26 of the captured nut.

Additionally, the net tightener of the subject invention includes a pair of circular segments 60 and 62 which are secured to the inner wall surface of the collar 52 and project downwardly therefrom so that they act as sleeve segments for positioning and holding the upper part of the net tightening assembly 20 in place on top of the net post 10.

As further shown in FIG. 4, one or more bolts 64 are inserted at threaded openings 66 in the post 10. These constitute the bolt locations for previously used external net tightening means which have been removed from the post 10. The insertion of the bolts 64 abut one side wall of the channel member 30 and act to lock the entire net tightening assembly 20 in position inside of the net post 10.

In order to raise and lower the hook nut block member 30 and thus apply tension to the net cable 16, the upper shank portion 37 which projects through the semi-circular top plate member 34 includes a square headed end portion 68 which can be engaged by a wrench 70 having an offset forward section 72 which includes a square hole 74 for engaging the head 68 of the threaded shaft 22.

When not in use, the wrench 70 is inserted down into the assembly 20 through the opening provided by the linear side edge 40 of the top plate 32. A protective top cover 76 is also provided which is adapted to fit the rim 56 of the collar 52 when the apparatus is not in use.

Thus what has been shown and described is an in-post net winder assembly which can be fitted as a complete unit to an existing net post by merely removing the top portion thereof including the means located thereon for passing the cable down to an external net tightening device which is also thereafter removed.

Having thus shown and described what is at present considered to be the preferred embodiment of the invention, it should be noted that the same has been made by way of illustration and not limitation. For example, the same apparatus can be configured for use with a net post of rectangular or square cross section. Accordingly, all modifications, alterations and changes coming within the spirit and scope of the invention as set forth in the appended claims are herein meant to be included.

I claim:

1. In combination, a tennis net post and an assembly for installation as a unit inside the upper end of the tennis net post for tightening a tennis net support cable, said assembly comprising;

top and bottom support plates;

an elongated threaded shaft journaled between said support plates and including a shank at its upper end, said shank having an end portion including means thereon for being turned;

a captured nut located on said threaded shaft and including means thereon for engaging one end of said net support cable;

means for restraining rotation of said nut causing the nut to thereby travel in a linear direction between said support plates when said shaft is turned in either direction to alternately loosen and tighten the tennis net support cable;

a protective collar attached at its lower end to the top support plate, said collar surrounding and being coextensive with said shank, and including an aperture for passage of said tennis net support cable therethrough and having a lower rim surface for engagement with the upper end of the net post;

said net post including an inner wall surface;

means attached to the lower portion of said collar and in slidable engagement with said inner wall surface of the net post for stabilizing and holding the upper portion of said assembly in position on top of the net post, and wherein said bottom plate includes a pair of opposing perimeter edge segments in slidable engagement with the inner wall surface of the net post for stabilizing and holding the lower portion of said assembly in position on top of the net post.

2. The assembly as defined by claim 1 and additionally including protective cover means on the top of said collar.

3. The assembly as defined by claim 1 and additionally including driver means connectable to said means on said shank for being turned.

4. The assembly as defined by claim 3 wherein said driver means comprises a wrench.

5. The assembly as defined by claim 1 wherein said collar and said net post define a common outer surface when said assembly is in position on said net post.

6. The assembly as defined by claim 1 wherein said collar comprises a generally cylindrical member having an upper rim portion and wherein said aperture comprises a slot formed in said upper rim portion.

7. The assembly as defined by claim 6 and additionally including means located on the inside of said collar adjacent said slot for guiding said support cable onto said means for engaging said one end of said support cable.

8. The assembly as defined by claim 1 wherein said captured nut includes a body portion having a pair of intersecting side walls and wherein said means for restraining rotation of said nut includes an elongated channel member secured to said support means.

9. The assembly as defined by claim 1 wherein said captured nut includes a square sided body member and wherein said means for restraining rotation of said nut comprises a right angled channel member.

10. The assembly as defined by claim 1 wherein said means for stabilizing and holding said assembly in position on the net post comprises at least one sleeve segment extending below the lower rim of said collar and being projectable inside of the upper end of the net post for engaging the inner wall surface thereof when said assembly is in position on said net post.

11. The assembly as defined by claim 1 wherein said pair of support means comprises top and bottom generally flat support plates and wherein said bottom support plate includes at least one perimeter edge which contacts the inside wall of said net post when said assembly is in position on said net post.

12. The assembly as defined by claim 1 wherein said collar and said net post have a cylindrical cross section.

13. The assembly as defined by claim 12 wherein said collar and said net post have a generally circular cylindrical cross section and have substantially the same outer diameter.

14. The assembly as defined by claim 12 wherein said top and bottom support plates comprise segments of a circle.

15. The assembly as defined by claim 14 wherein the inner wall surface of the net post is generally of circular cross section and wherein said bottom plate includes at least one circular perimeter edge engaging the inner wall surface of said net post.

16. The assembly as defined by claim 15 wherein said bottom plate includes a pair of parallel chord edges and said pair of opposing perimeter edges terminating at said chord edges.

17. The assembly as defined by claim 14 wherein said top plate includes a chord edge and a circular perimeter edge terminating in said chord edge, and wherein said circular perimeter edge is secured to the inner wall surface of said collar.

18. The assembly as defined by claim 14 wherein said top support plate includes a single chord edge and a circular perimeter edge having a length greater than one half the perimeter of the inner wall surface of said collar and secured thereto;

said bottom support plate includes a pair of parallel chord edges and at least one circular perimeter edge terminating at said pair of chord edges, said at least one circular perimeter edge of said bottom support plate abutting the inner wall surface of said net post when said assembly is in position on said net post, said top and bottom support plates further having a pair of centrally located holes therein for receiving opposite ends of said threaded shaft therein.

19. The assembly as defined by claim 18 wherein said single chord edge of said top support plate is positioned behind the aperture in said collar for providing a passage of the net support cable to said captured nut on the threaded shaft.

20. The assembly as defined by claim 18 wherein said means for stabilizing and holding said assembly in position on top of the net post comprises a pair of generally circular sleeve segments attached to and depending from the inner surface of said collar and engaging the inner wall surface of the net post when said assembly is in position on said net post.

* * * * *